United States Patent [19]

Bergquist et al.

[11] Patent Number: 4,699,244

[45] Date of Patent: Oct. 13, 1987

[54] EXHAUST SILENCER DEVICE FOR AN INTERNAL COMBUSTION ENGINE

[75] Inventors: Karl Bergquist, Harestad; Magnus Sundemo, Mölndal, both of Sweden

[73] Assignee: AB Volvo, Gothenburg, Sweden

[21] Appl. No.: 841,667

[22] Filed: Mar. 19, 1986

[30] Foreign Application Priority Data

Mar. 19, 1985 [SE] Sweden ..... 8501333

[51] Int. Cl.[4] ..... F01N 1/08

[52] U.S. Cl. ..... 181/226; 181/254; 181/278

[58] Field of Search ..... 181/226, 236, 237, 241, 181/254, 277, 278

[56] References Cited

U.S. PATENT DOCUMENTS 2,072,372 3/1937 Kingsley ..... 181/254 X
2,492,784 12/1949 Christman ..... 181/236
3,703,937 11/1972 Tenney ..... 181/226
4,161,996 7/1979 Dolejsi ..... 181/237 X
4,484,659 11/1984 Buchwalden ..... 181/237 X

FOREIGN PATENT DOCUMENTS 342664 2/1972 Sweden .

*Primary Examiner*—Benjamin R. Fuller
*Attorney, Agent, or Firm*—Young & Thompson

[57] ABSTRACT

The invention relates to an exhaust silencer device for an internal combustion engine, for placement in the exhaust pipe of the engine. The device according to the invention comprises a damper plate disposed in the exhaust pipe and pivotably about a shaft substantially perpendicular to the longitudinal axis of the exhaust pipe between a closed position, in which the damper plate covers the major portion of the exhaust pipe flow area, and an open position, in which it permits substantially free flow through the exhaust pipe. An operating device is arranged to actuate the damper plate to adjust its position dependent on the exhaust flow through the exhaust pipe.

6 Claims, 4 Drawing Figures

EXHAUST SILENCER DEVICE FOR AN INTERNAL COMBUSTION ENGINE

The invention relates to an exhaust silencer device for internal combustion engines, said device including a vlave, placed in the exhaust pipe of the engine for controlling the flow-through area of the exhaust pipe, and an operating means for actuation of the valve.

In order to silence exhaust noise from internal combustion engines it is common to use one or more silencers arranged in the engine exhaust pipe, in the form of containers through which the exhaust flow is directed and which are provided with means for reducing the pressure pulses in the exhaust flow which give rise to the exhaust noise. These silencers are relatively heavy and are relatively space-consuming. Furthermore, these known silencers, in order to provide effective silencing, must be adapted to the characteristics of the engine to which it is to be applied. This means that different silencers must be used for different engines, which is of course a considerable disadvantage with regard to standardization.

The purpose of the present invention is to achieve an exhaust silencer device for internal combustion engines, which, on the one hand, makes it possible to reduce the weight and volume of the engine exhaust system, and, on the other hand, can be adapted to different internal combustion engines to achieve the best possible exhaust silencing effect.

According to the invention this is achieved by means of a device of the type described by way of introduction, which is primarily characterized in that the operating means is arranged to actuate the valve in response only to the exhaust flow through said pipe to increase the flow-through area with increasing exhaust flow.

The invention will be described in more detail below with reference to the accompanying drawing.

Figure 1:
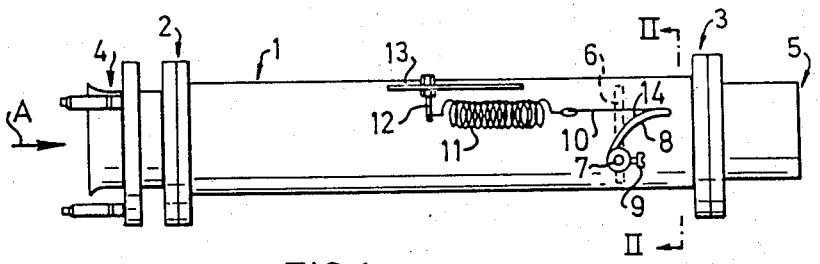
Figure 2:
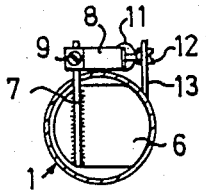
Figure 3:
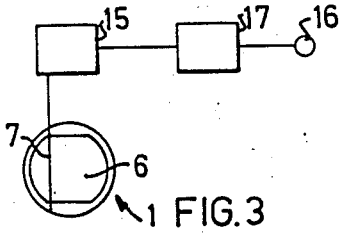
Figure 4:
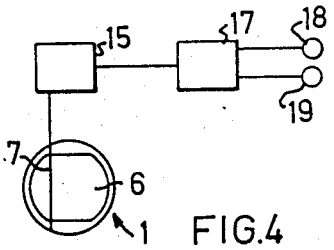

FIG. 1 shows a schematic plan view of a device according to one embodiment of the invention, FIG. 2 shows a section along the line II—II through the device shown in FIG. 1, FIG. 3 shows a section corresponding to FIG. 2 but showing a second embodiment of an operating means, and FIG. 4 shows a section corresponding to FIGS. 2 and 3 but showing a third embodiment of the operating means.

The embodiment of the device according to the invention shown in FIGS. 1 and 2 is arranged in a pipe 1, which is designed to be mounted in an exhaust system or an exhaust pipe by means of flange mountings 2 and 3. The drawing does not show the combustion engine, and only short portions 4 and 5 of the exhaust pipe are shown. Exhaust flows from the combustion engine through the exhaust pipe and the pipe 1 coupled therein in the direction shown by the arrow A in FIG. 1.

A damper plate 6 is arranged in the pipe 1. The damper plate 6 is carried by a shaft 7, which extends through the pipe 1 in a direction substantially perpendicular to the longitudinal axis of the pipe. The shaft 7 is spaced away from the center of the damper plate 6, so that the exhaust flow in the direction of the arrow A will produce a torque on the damper plate 6 tending to pivot it clockwise about the shaft 7, as seen in FIG. 1. The damper plate 6 can be swung between the closed position shown in the drawing, wherein the damper plate 6 covers most of the flow area in the pipe 1, and an open position, wherein the damper plate 6 is substantially parallel to the longitudinal axis of the pipe 1 and the exhaust can flow essentially unimpeded through the pipe 1.

One end of the shaft 7 extends through the pipe 1 and the end of the shaft 7 which extends out of the pipe 1 is provided with an operating arm 8, which is fixed by means of a lock screw 9 to the shaft 7. The end of the operating arm 8 remote from the shaft 7 is connected by means of a flexible connecting element 10 (in this case a wire), to one end of a tension spring 11, the other end of which is attached to a set screw 12. The set screw 12 is carried by a carrier plate 13 and is displaceable in a slot therein and can be locked in the desired position along the slot to adjust the force of the tension spring 11. The spring 11 will thus exert, via the connecting element 10, the operating arm 8 and the shaft 7, a torque on the damper plate 6, which is counter to the torque on the damper plate 6 exerted by the exhaust flow.

In order to provide the best possible silencing effect, especially at low frequencies, the damper plate 6 should provide a substantially constant counter-pressure in the pipe 1. This means that the torque which the tension spring 11 exerts on the damper plate 6 must become less and less the farther the damper plate 6 is swung from the closed position shown in the drawing. According to the embodiment of FIGS. 1 and 2 this is achieved by arranging the operating arm 8 relative to the tension spring 11 so that the effective lever or movement arm about the shaft 7, as the damper plate 6 is swung from the closed to the open position, is reduced more rapidly than what is required to compensate for the increasing spring force exerted by the tension spring 11 during this pivot movement. As can be seen in FIG. 1, the operating arm 8 in the embodiment shown is in the form of a curved arm which has a convex surface 14 facing the tension spring 11. As the damper plate 6 and the operating arm 8 are pivoted about the shaft 7 in a clockwise direction as seen in FIG. 1, i.e. from the closed position to the open position, the flexible connecting element 10 will lie more and more against the convex surface 14, which will thus determine the length of the effective moment arm relative to the shaft 7. In this way it is possible by suitable design of the operating arm 8 and the curved surface 14 thereof to adapt the torque exerted on the damper plate 6 by the tension spring 11 to the requirements of the field of application in question. Specific adjustments can be made by sliding the set screw 12 and by rotating the operating arm 8 relative to the shaft 7. It is thus possible to set the counterpressure exerted by the damper plate 6 in the pipe 1, making it possible to adjust the counter-pressure to suit different combustion engines, and to reduce the number of different exhaust systems. The counter-pressure can be set either to achieve maximum silencing or to achieve a maximum performance of the engine. In the former case it is possible to achieve a silencing effect hitherto unachieveable by conventional silencers without significantly reducing the performance of the engine.

FIG. 3 shows schematically a second embodiment of the device according to the invention, and this embodiment differs from the embodiment according to FIGS. 1 and 2 only as regards the operating means. In the embodiment according to FIG. 3, the swinging of the damper plate 6 about the shaft 7 is achieved by means of drive means 15 in the form of a servo-motor or step motor, which is coupled to the shaft 7. To control the movement of the drive means 15, a sensor device is disposed to produce an output signal, which has a predetermined relationship to the exhaust flow through the exhaust pipe, i.e. through the pipe 1. The sensor device comprises in the embodiment according to FIG. 3, a sensor means 16, which can consist of a flow meter disposed in the exhaust pipe, and a signal processing device 17 for processing the output signal from the sensor means 16 and transmitting a control signal to the drive means 15. The signal processing device 17 consists of a known type of signal processing equipment and is made so that an exhaust flow of a certain magnitude through the exhaust pipe produces a certain position of the damper plate 6. By changing the characteristics of the signal processing device 17, it is possible to achieve an adaption of the counter-pressure in the pipe 1 exerted by the damper plate 6 to different combustion engines, as indicated above.

FIG. 4 shows a third embodiment of the device according to the invention, the main characteristics of which correspond to the embodiment according to FIG. 3. In the embodiment according to FIG. 4, however, there are instead of the sensor means 16, two separate sensor means 18 and 19, which are coupled to the signal processing device 17 and are designed to sense different operating parameters of the combustion engine. It is thus possible for the sensor means 18 to sense for example the engine rpm, while the sensor device 19 can sense the engine load. The output signals from the sensor means 18 and 19 thus provide information concerning the exhaust flow through the exhaust pipe, and this information can be fed to the signal processing device 17, which sends an output signal for controlling the drive means 15. With this embodiment as well, it is of course also possible to adjust it to different combustion engines by changing the characteristics of the signal processing device 17.

The invention is of course not limited to the examples described above. Rather, changes can be made within the scope of the attached patent claims.

I claim:

1. Exhaust silencer device for an internal combustion engine, said device including a valve, placed in the exhaust pipe of the engine and comprising a damper plate for controlling the flow-through area of the exhaust pipe, said damper plate being pivotable about a shaft, mounted substantially perpendicular to the longitudinal direction of the exhaust pipe, between a closed position, in which it cover the major portion of the cross-sectional flow-through area of the exhaust pipe, and an open position, in which it permits substantially free flow through the exhaust pipe, the shaft being offset from the center of the damper plate, so that the exhaust flow in the exhaust pipe exerts an opening torque on the damper plate toward open position, and operating means for controlling the position of the damper plate, said operating means being arranged to actuate the damper plate in response only to the exhaust flow through the exhaust pipe by exerting a closing torque on the damper plate, said closing torque decreasing with increasing opening angle of the damper plate.

2. Device according to claim 1, characterized in that the operating means consists of an operating arm joined to the damper plate, and a spring which resiliently actuates the operating arm to exert a torque on the damper plate in the direction of the closed position.

3. Device according to claim 2, characterized in that the spring consists of a tension spring, that the operating arm is formed with a curved surface radially from the pivot shaft of the damper plate, and that a flexible connecting member is fixed at its one end to the spring and at its other end to the radially outer portion of the curved surface of the operating arm, which is directed relative to the spring so that the connecting member lies against the curved surface when the damper plate is in its open position and as the damper plate is swung from its open position towards its closed position, the connecting member is rolled off from the curved surface.

4. Device according to claim 1, characterized in that the operating means consists of a drive means joined to the damper plate and a sensor arrangement for producing an output signal in a predetermined relationship to the exhaust flow through the exhaust pipe, said output signal being supplied to the drive means for controlling the movement thereof.

5. Device according to claim 4, characterized in that the sensor arrangement consists of a flow meter placed in the exhaust pipe, and a signal processing device, which is coupled to the drive means for controlling the movement thereof.

6. Device according to claim 4, characterized in that the sensor arrangement consists of one or more sensor means for sensing one or more operating parameters of the internal combustion engine, and a signal processing device, to which is in turn coupled to the drive means for controlling the movement thereof.

* * * * *